US007196605B2

(12) United States Patent
Ohno et al.

(10) Patent No.: US 7,196,605 B2
(45) Date of Patent: Mar. 27, 2007

(54) INDUCTANCE ELEMENT AND CASE

(75) Inventors: Daigo Ohno, Ome (JP); Takashi Matsuoka, Ome (JP)

(73) Assignee: Nippon Chemi-Con Corporation, Tokyo (JP)

( * ) Notice: Subject to any disclaimer, the term of this patent is extended or adjusted under 35 U.S.C. 154(b) by 0 days.

(21) Appl. No.: 10/670,571

(22) Filed: Sep. 26, 2003

(65) Prior Publication Data

US 2004/0075516 A1 Apr. 22, 2004

Related U.S. Application Data

(63) Continuation of application No. PCT/JP02/03181, filed on Mar. 29, 2002, now abandoned.

(30) Foreign Application Priority Data

Mar. 30, 2001 (JP) ..... 2001-101247
Jun. 28, 2001 (JP) ..... 2001-196108

(51) Int. Cl.
*H01F 27/02* (2006.01)

(52) U.S. Cl. ..... 336/83

(58) Field of Classification Search ..... 336/83, 336/175, 200, 206–208, 220–223
See application file for complete search history.

(56) References Cited

U.S. PATENT DOCUMENTS 5,815,060 A * 9/1998 Matsumoto et al. ..... 336/175
6,012,219 A * 1/2000 Kato et al. ..... 29/606
6,137,389 A * 10/2000 Uchikoba ..... 336/83
6,160,465 A * 12/2000 Yamaguchi et al. ..... 336/110
6,310,534 B1 * 10/2001 Brunner ..... 336/174
6,356,179 B1 * 3/2002 Yamada ..... 336/175
6,483,409 B1 * 11/2002 Shikama et al. ..... 336/83

FOREIGN PATENT DOCUMENTS

| | | |
|---|---|---|
| JP | 59-107111 | 7/1984 |
| JP | 7-226639 | 8/1995 |
| JP | 9-69444 | 3/1997 |
| JP | 11-176653 | 7/1999 |

* cited by examiner

*Primary Examiner*—Tuyen T. Nguyen
(74) *Attorney, Agent, or Firm*—Westerman, Hattori, Daniels & Adrian, LLP

(57) ABSTRACT

An inductance element and a case; the inductance element, comprising a winding type magnetic core having a hollow part formed by winding a magnetic ribbon thereon and a lead having a cross sectional dimension smaller than the inner diameter of the hollow part of the magnetic core and passing the hollow part, wherein a clearance is provided between the magnetic core and the lead; the case, comprising a plurality of members combined with each other, wherein the members are connected to each other in a surface including one or more case ridge lines.

1 Claim, 11 Drawing Sheets

DEPENDENCY OF NOISE GENERATION AMOUNT ON FREQUENCY (MAGNETIC CORE SIZE: OUTER DIAMETER Ö11 - INNER DIAMETER Ö1.8 - LENGTH 10, CASE INNER DIAMETER Ö11.5, LEAD DIAMETER Ö1.6)

INDUCTANCE ELEMENT AND CASE

This is a continuation of Application PCT/JP02/03181, filed on Mar. 29, 2002, now abandoned.

BACKGROUND OF THE INVENTION

1. Technical Field

The present invention relates to an inductance element such as a choke coil and to a case that contains the inductance element.

2. Background Art

An inductance element disclosed in JP 08-172019 A or the like has been known as one in which a magnetic ribbon such as an iron base amorphous alloy ribbon is wound around on a core having a hollow part, a lead is passed through the core, and the wound magnetic core is contained in a case.

The inductance element is constructed by a toroidal magnetic core having a magnetic alloy foil strip wound therearound, a case that contains the magnetic core, and a lead which is passed through the magnetic core and the case, and has a structure in which the lead is fixed to a body to be connected which is the surface mounting of a circuit board or the like.

This inductance element thinks of exfoliation prevention from said a body, and a front edge department of an above lead line consists of it to become parallel to the surface of a body.

Also, in the inductance element, it is suitable that a maximum length of a cross section of the lead is 0.8 times to 1.2 times the inner diameter of the magnetic core. In the inductance element, with a state in which the lead is inserted into the toroidal magnetic core, the magnetic core is subjected to heat treatment to produce distortion, thereby fixing the lead to the toroidal magnetic core.

Also, in the above-mentioned publication, it is noted that if a clearance is present between the case and the magnetic core, the magnetic core moves, so that it is necessary to fix the case and the magnetic core using a grease, an adhesive, a resin, or the like.

However, in the above-mentioned conventional technique, consideration is not given to vibration resulting from interaction between a current flowing through the lead and the magnetic core, vibration of the case caused due to the vibration, noises resulting from those vibrations, or the like.

Therefore, in a magnetic wound core around which a magnetic ribbon made of, for example, iron base amorphous metal is wound around on a core, when a current is made to flow through a lead, the magnetic core is excited. Magnetostriction is caused by the excitation, which reliably causes vibration. When the vibration thus caused is in an audio frequency range, there is the case where the vibration is propagated as noise throughout the surrounding area. In addition, when the inductance element is bonded to an object to be bonded such as a circuit board, there is the case where parts in the periphery of the inductance element are vibrated, thereby deteriorating operating characteristics of the object to be bonded.

Thus, consideration has been on the idea of containing the magnetic core in the case to obtain a hermetically sealed structure, thereby cutting off the noise caused in the magnetic core to reduce the outside noise leaked of the case, however, when the inductance element in which the lead is passed through the magnetic core is contained in the case, it is required to provide a manufacturing order in which the case is formed in advance so as to be composed of a plurality of members and the members are combined after the core is contained in the case.

Such bonding of the members is generally conducted by a method using an adhesive, ultrasonic bonding, or the like. Further, the larger the area of a bonding region, the more advantageous the above-mentioned bonding method is, in terms of bonding strengths of the respective members in the bonding.

The area of the bonding region is widened as thicknesses of the members composing the case increase. However, there is a problem in that when the thicknesses of the members are increased, a size of the case is accordingly increased.

The present invention has been made in view of such problems of the conventional techniques. Therefore, an object of the present invention is to, in the inductance element which is provided with the winding type magnetic core and the lead, reduce vibration resulting from a current flowing through the lead or noise leaked to the outside of the element.

Also, another object of the present invention is to, in the inductance element, increase the area of the bonding region of the members composing the case without increasing the size of the case that contains the element.

SUMMARY OF THE INVENTION

In order to solve the above-mentioned problem, the following means is employed in the present invention. In other words, according to the present invention, there is provided an inductance element comprising: a magnetic wound core having a hollow part, which is formed by winding a magnetic ribbon therearound; and a lead that has a cross sectional dimension smaller than the inner diameter of the hollow part of the magnetic core and is passed through the hollow part, in which a clearance is provided between the magnetic core and the lead.

By providing the clearance between the winding type magnetic core and the lead, the vibration is not propagated between the magnetic core and the lead, thereby reducing noise.

Also, it is preferable that the inductance element further comprise a case with a hermetically sealed structure that contains the magnetic core and that the lead be passed through the case in a hermetic sealing state. With such a case having the hermetically sealed structure, noise is further reduced.

Also, it is preferable that the case have an accommodation space adaptable to an appearance shape of the winding type magnetic core and a clearance be provided between an inner surface of the accommodation space and an outer surface of the magnetic core. According to the structure, the vibration of the magnetic core is not propagated to the case, thereby reducing noise.

Also, according to the present invention, there is provided an inductance element including: a cylindrical magnetic core having a hollow part; a case for hermetically sealing the magnetic core, which has a cylindrical part composing a hollow part that contains the magnetic core and side wall members made of metal, the side wall members being opposed to side surfaces of both ends of the magnetic core in both ends of the cylindrical part and composing cover parts for the hollow part, and which hermetically seals the magnetic core; and a lead that is passed through the hollow part of the magnetic core both ends of which are connected with the respective side wall members, the side wall members have edge parts extended in an outside direction of the cylindrical part in both the ends of the above-mentioned cylindrical part, the edge parts compose conductive contact parts to an object to be bonded outside of the cylindrical part.

It is preferable that an iron base amorphous alloy ribbon be used as the above-mentioned magnetic ribbon. For the iron base amorphous alloy ribbon, iron base amorphous metals such as Fe—B, Fe—B—C, Fe—B—Si, Fe—Si—C, Fe—B—Si—Cr, Fe—Co—B—Si, or Fe—Ni—Mo—B can be given as an example.

Among the above-mentioned iron base amorphous metals, more preferably, $Fe_xSi_yB_zM_w$ can be given as an example. Here, X ranges from 50 to 85, Y ranges from 1 to 15, and Z ranges from 5 to 25 (X, Y, and Z respectively indicate atomic %). In addition, M represents one kind of metal such as Co, Mn, C, Al, or P or a combination of two or more kinds of those metals and metal with W=0 to 5 atomic % can be given as an example.

The iron base amorphous metal is a material that causes large magnetostriction at the time of excitation to readily cause vibration is easy to generate, though by adopting the above-mentioned structure, the vibration is not propagated, so that noise can be reduced.

Further, in order to solve the above-mentioned another problem, the following means is employed in the present invention. That is, according to the present invention, there is provided an inductance element including: a cylindrical magnetic core having a hollow part; a case that has a rectangular cross sectional outside shape and contains the magnetic core; and a lead that is passed through the hollow part of the magnetic core and the case, and an above case has a plurality of members and the members are bonded to each other in a surface including at least one ridge line of the case.

Also, according to the present invention, there is provided a case that has a rectangular cross sectional outside shape and contains an element including a cylindrical magnetic core having a hollow part and a lead that is passed through the cylindrical magnetic core, comprising two members bonded to each other in a surface including at least one ridge line of the case.

As described above, when the two members are bonded to each other, the bonding distance of a bonding region can be increased without increasing the dimensions of the case.

DETAILED DESCRIPTION OF THE PREFERRED EMBODIMENTS

Hereinafter, an inductance element and a case according to embodiment modes of the present invention will be described with reference to the drawings.

<First Embodiment Mode>

An inductance element according to a first embodiment mode of the present invention will be described with reference to FIGS. 1 and 2.

Figure 1:
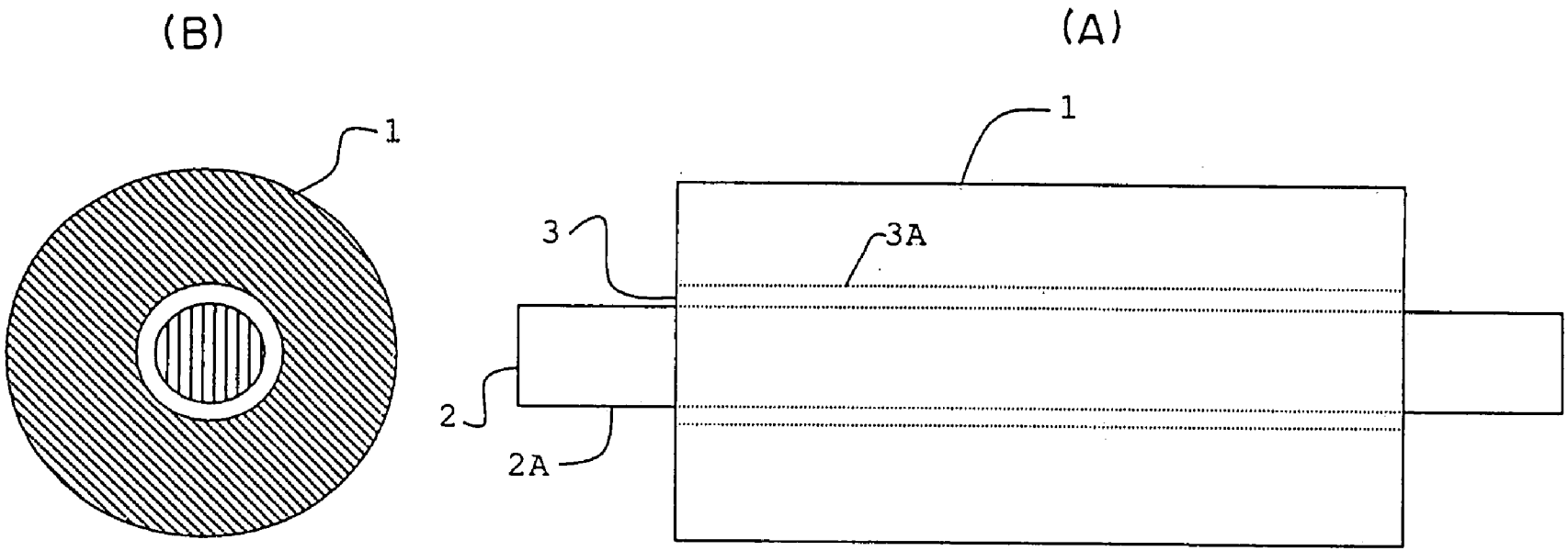
FIG. 1 shows a structure of an inductance element according to a first embodiment mode of the present invention.
Figure 2:
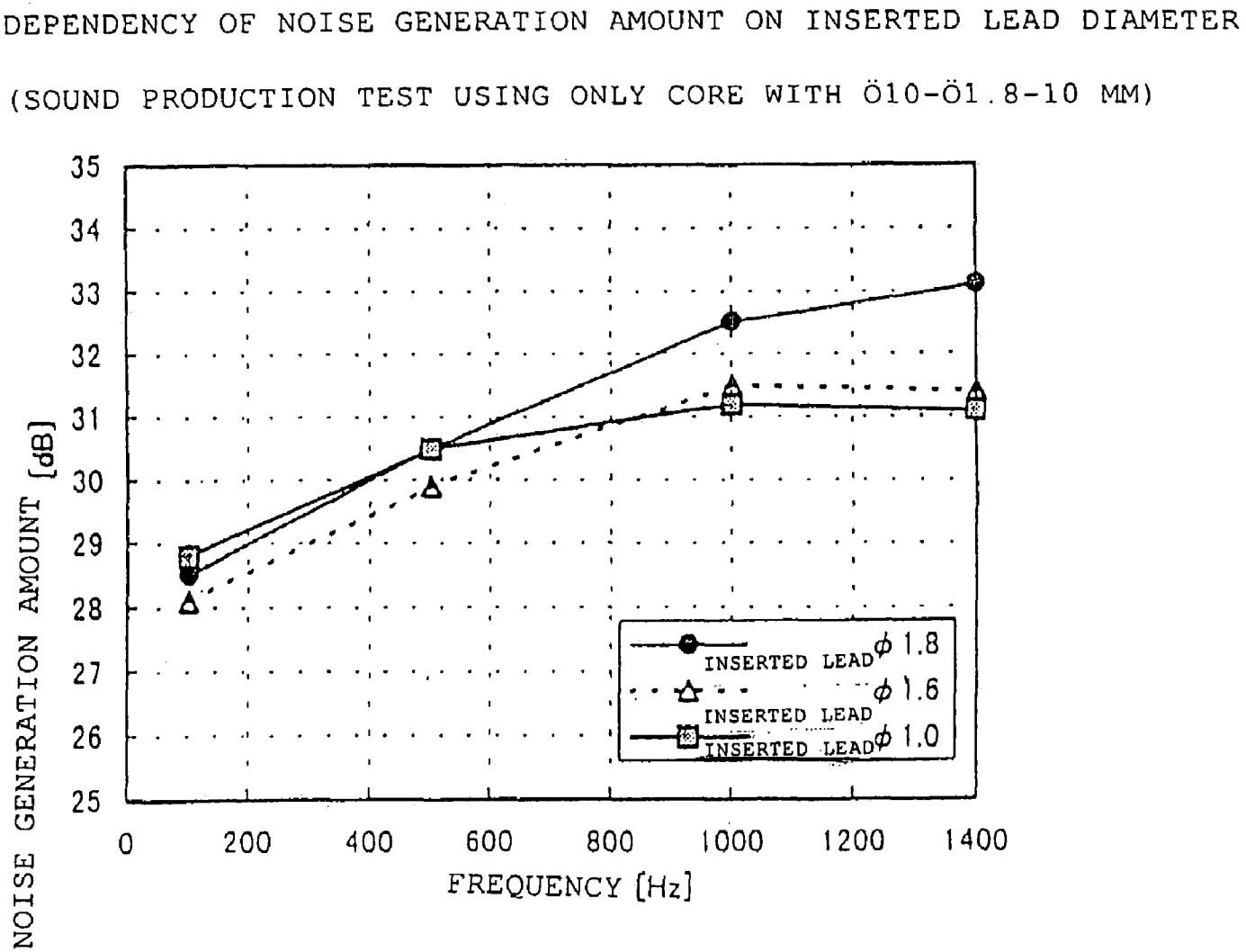
FIG. 2 shows measurements of a noise generation amount characteristic in the inductance element.

FIG. 1 shows a structure of the inductance element and FIG. 2 shows measurements of a noise generation amount characteristic in the inductance element. As shown in FIG. 1, the inductance element has a structure in which a lead 2 is passed through a cylindrical core 1 having a hollow part 3. A support member for fixing the core 1 and the lead 2 is not provided, so that the core 1 is rotatable and slidable with respect to the lead 2.

The core 1 is manufactured by winding an iron base amorphous magnetic alloy foil strip produced by Allied Signal Inc. USA, one side surface of which is coated with a fine powder of $Sb_2O_5$, around on a roller having a diameter of 1.8 mm, and dimensions of the core thus manufactured are 1.8 mm in inner diameter (diameter, same for the following), 8.2 mm in outer diameter (diameter, same for the following), and 15 mm in length.

A wound portion of the core 1 is hardened by spark welding. Then, the core 1 is subjected to heat treatment for 2 hours at a temperature which is equal to or larger than a Curie temperature and equal to or smaller than a crystallization temperature, more specifically, at 435° C.

The lead 2 having a diameter of 1.8 mm is inserted into the hollow part 3 of the core 1 to produce an element L1. In addition, a lead 2 having a diameter of 1.6 mm is inserted into a core 1 which has the same shape as that of the above-mentioned core 1 and is made of the same material as that of the above-mentioned core 1 to produce an element L2. Further, a lead 2 having a diameter of 1.0 mm is inserted into a core 1 which has the same shape as that of the above-mentioned core 1 and is made of the same material as that of the above-mentioned core 1 to produce an element L3.

Therefore, in the element L1, there is no clearance between an inner wall 3A of the hollow part 3 and an outer surface 2A of the lead 2. Further, in the elements L2 and L3, clearances of 0.1 mm and 0.4 mm are respectively created between the inner wall 3A of the hollow part 3 and the outer surface 2A of the lead 2.

A current is supplied to the three kinds of inductance elements under the following measurement condition described in Table 1 below and sound production quantities from the elements are measured by using a microphone.

TABLE 1

| | |
|---|---|
| Supply Current (A) | 4.5 |
| Duty Factor (%) | 50 |
| Slow Rate (V/μs) | 50 |
| Measurement Frequency [Hz] | 100 to 1400 |
| Distance to Microphone (cm) | 10 |

FIG. 2 shows measurements. In FIG. 2, the abscissa indicates a measurement frequency of a supply current and the ordinate indicates a noise generation amount. In addition, in FIG. 2, polygonal line graphs of inserted lead Ö of 1.8, 1.6, and 1.0 show measurements with respect to the element L1 in which the lead 2 has the diameter of 1.8 mm, the element L2 in which the lead 2 has the diameter of 1.6 mm, and the element L3 in which the lead 2 has the diameter of 1.0 mm.

As is apparent from FIG. 2, the noise generation amount is smaller in the element in which the diameter of the lead 2 is smaller than the inner diameter (1.8 mm) of the core 1. For example, at a frequency of 1400 Hz, the noise generation amount is reduced to 31 (dB) in both the element L2 and the element L3 as compared with the noise generation amount of 33 (dB) in the element L1.

<Second Embodiment Mode>

Figure 3:
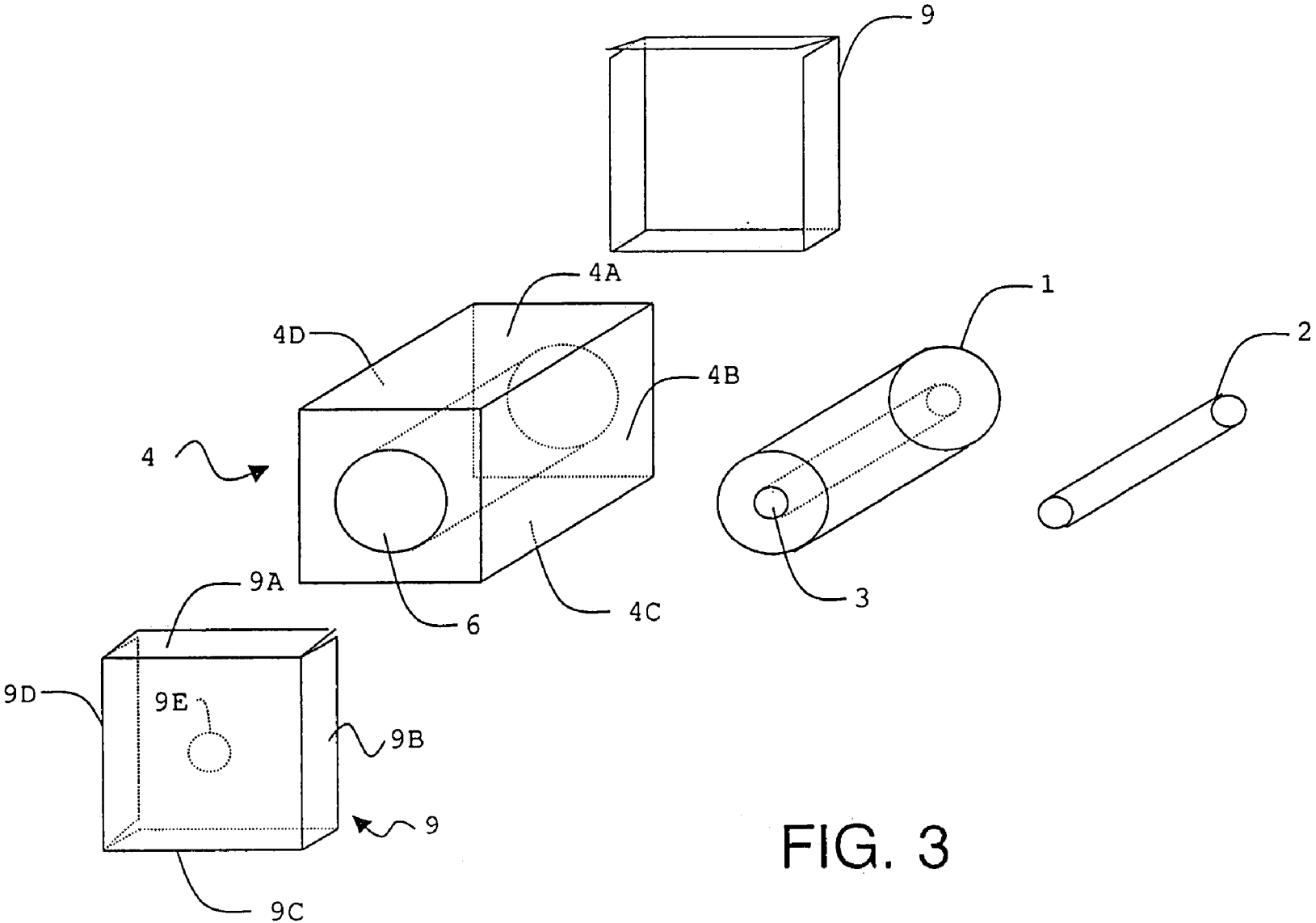
FIG. 3 is an exploded view showing structural elements of an inductance element according to a second embodiment mode of the present invention.
Figure 4:
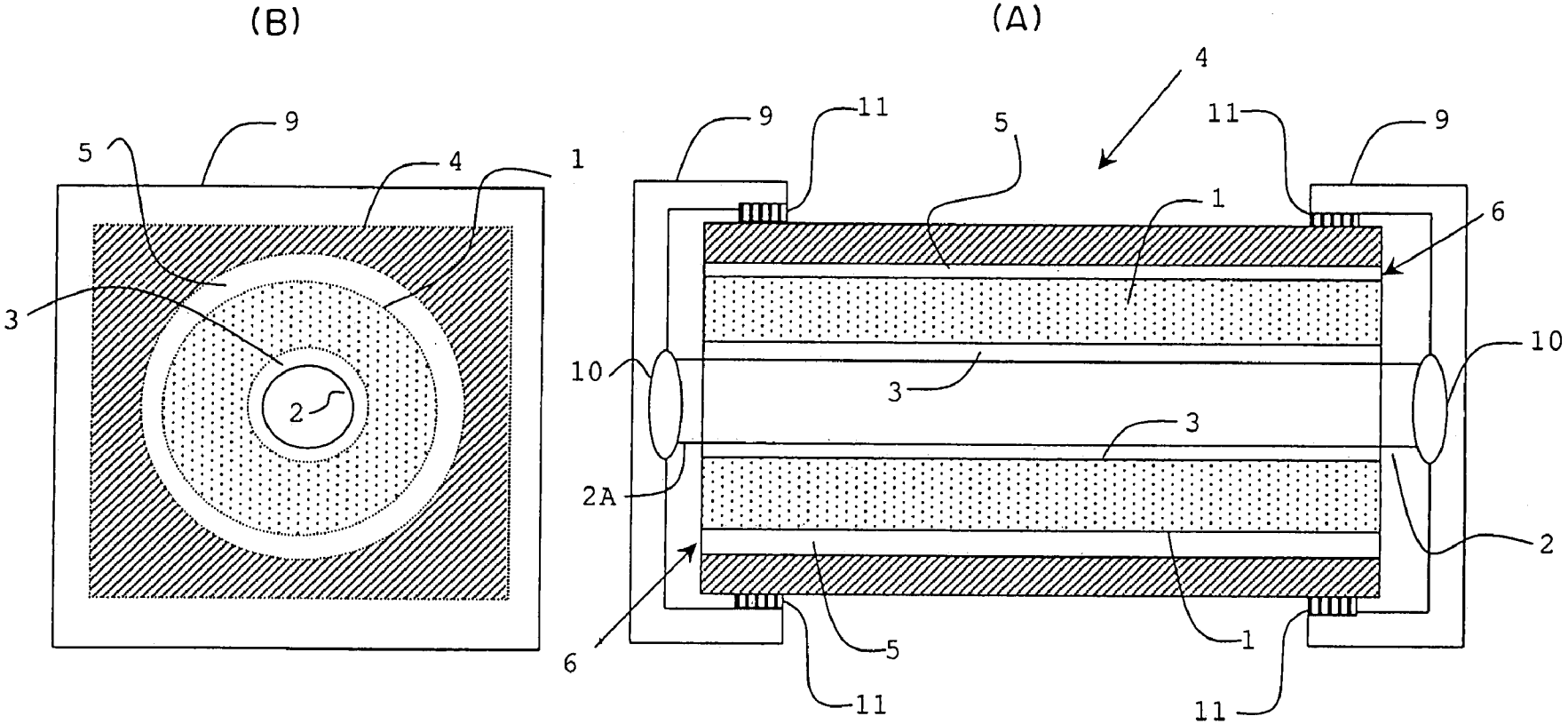
FIG. 4 shows a structure of an inductance element.
Figure 5:
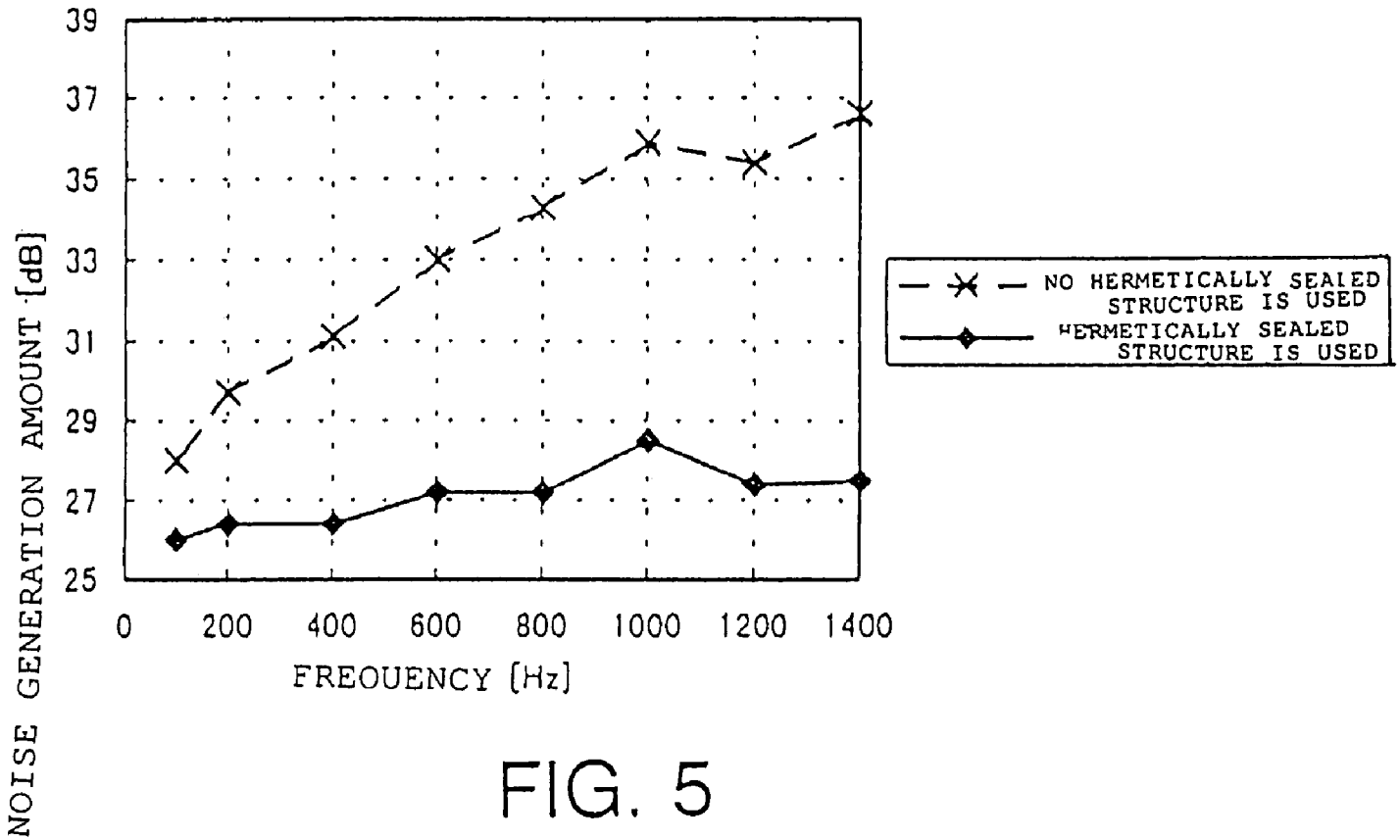
FIG. 5 shows measurements of a noise generation amount characteristic in the inductance element.
Figure 6:
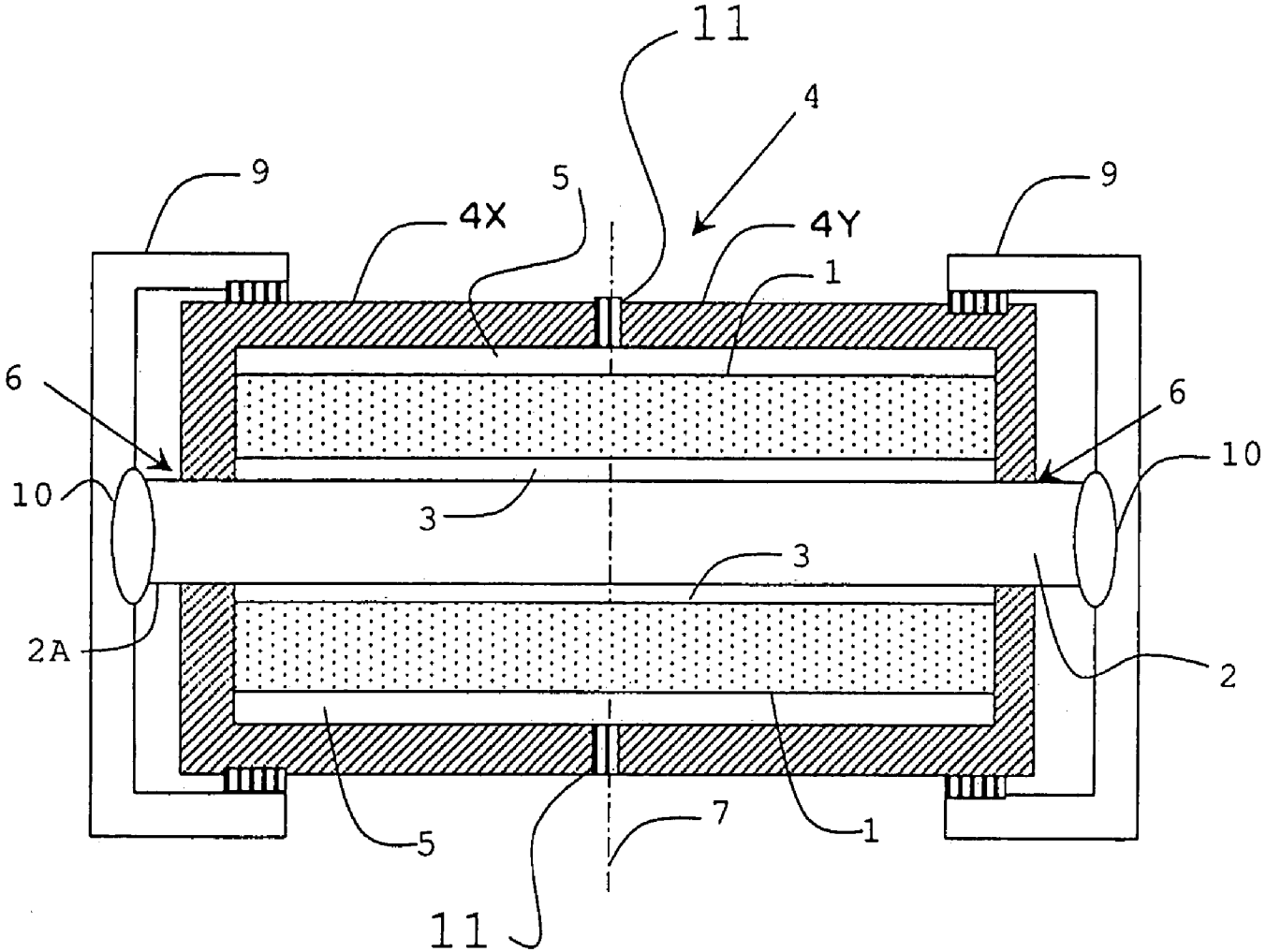
FIG. 6 is a sectional view showing a structure of an inductance element according to a modified example of the second embodiment mode.

An inductance element according to a second embodiment mode of the present invention will be described with reference to FIGS. 3 to 6. FIG. 3 is an exploded view showing structural elements of the inductance element. FIG. 4 is sectional views showing a structure of the inductance element. FIG. 5 shows measurements of a noise generation amount characteristic in the inductance element, and FIG. 6 is a sectional view showing a structure of an inductance element according to a modified example of this embodiment mode.

In the above-mentioned first embodiment mode, the noise generation amount characteristic of the inductance element in which the lead 2 has been passed through the core 1 having the hollow part 3 has been described. In this embodiment mode, an inductance element provided with a case 4 that has a hermetically sealed structure and contains the core 1 described in the first embodiment mode will be described. In this embodiment mode, a structure other than the case 4 is the same as that in the first embodiment mode. Accordingly, the same reference symbols are given to the same structural elements and the description thereof is omitted here.

As shown in FIG. 3, the inductance element has a structure in which an element having the same structure as that of the inductance element of the first embodiment mode which is composed of the core 1 and the lead 2 is hermetically sealed in a case 4 made of a PPS (polyphenylene sulfide) resin and side wall members 9 (electrodes). The case 4 is composed of four sidewalls 4A to 4D and two end surfaces each having an opening part 6.

The element composed of the core 1 and the lead 2 is inserted into a hollow part 5 of the case 4. Then, the side wall members 9 and the lead 2 are soldered at both end portions of the case 4 to fix the case 4 and the side wall members 9 with an adhesive to manufacture the inductance element according to this embodiment mode.

Here, the side wall members 9 each have a bottom wall that covers the end surface of the case 4, and four side walls 9A to 9D which are bent with respect to the bottom wall and provided perpendicular to the bottom wall. The four side walls 9A to 9D are bonded to the side walls 4A to 4D of the case 4, respectively with an adhesive to hermetically seal the case 4.

Also, the side walls 9A to 9D form conductive contact portions on the side walls 4A to 4D of the case 4. Therefore, the inductance element is constructed which is capable of being mounted through an arbitrary surface of the side walls 4A to 4D.

Note that, in order to facilitate soldering, an opening 9E through which the lead 2 is passed may be provided near the center of the bottom wall of the case 4.

Sectional views of the inductance element are shown in FIG. 4. As shown in FIG. 4, the case 4 made of a PPS resin has the hollow part 5 and the opening parts 6. The core 1 through which the lead 2 is passed is accommodated in the hollow part 5 through the opening part 6.

Further, in the case 4, the opening parts 6 are covered with a pair of side wall members 9 from both sides thereof. Upon the covering, the side wall members 9 and the lead 2 are soldered by solder 10.

Furthermore, the side wall members 9 are bonded to the case 4 with adhesives 11. As a result, the inductance element composed of the core 1 and the lead 2 is hermetically sealed by the case 4 and the side wall members 9.

Note that, in FIG. 4, the inner diameter of the hollow part 5 of the case 4 is 11.5 mm, the outer dimension of the core 1 is 11 mm, the inner diameter of the hollow part 3 of the core 1 is 1.8 mm, and the outer dimension of the lead 2 is 1.6 mm.

FIG. 5 shows measurements with respect to the inductance element shown in FIG. 3. In FIG. 5, a polygonal line graph indicating that "the hermetically sealed structure is used" shows a noise generation amount characteristic in the inductance element having the structure shown in FIG. 4.

Also, in FIG. 5, a polygonal line graph indicating that "no hermetically sealed structure is used" shows a noise generation amount characteristic in an inductance element having the structure in which the adhesives 11 are not used in the structure shown in FIG. 4, so that the side wall members 9 and the case 4 are not bonded.

As shown in FIG. 5, by employing the case having the hermetically sealed structure for the inductance element shown in FIG. 4 to suppress vibration of the lead 2, a reduction in noise generation amount can be recognized. In this example, at a frequency of 1400 (Hz) the noise generation amount is reduced from about 36.5 (dB) to 27.5 (dB).

As described above, in this embodiment mode, the element is inserted through the opening part 6 of the case 4 having the hollow part 5 to manufacture the inductance element having the hermetically sealed structure. However, the embodiment of the present invention is not limited to such a structure and a procedure.

FIG. 6 shows an example in which left and right parts 4X and 4Y are combined to assemble the case 4. The case 4 is produced by bonding the bonding regions of the left and right parts 4X and 4Y with the adhesive 11. According to such a structure, the inner diameter of the opening part 6 of the case 4 can be reduced up to the order of the outer diameter of the lead 2, so that a hermetic sealing effect can be further improved.

Also, in the present invention, the case 4 may be composed of parts divided in a cross section parallel to the longitudinal direction. In addition, the case 4 may be composed of a cylindrical part having an opening end in which a side wall is provided perpendicular to a bottom of the case 4 and a cover part that hermetically seals the opening end of the cylindrical part. Further, the parts 4X and 4Y composing the case may be bonded to each other by ultrasonic bonding without using an adhesive. Furthermore, the case 4 may be made of a resin other than PPS or a material other than the resin.

As shown in FIG. 3, the side wall members 9 completely cover both end surfaces of the case in the above-mentioned embodiment mode. However, the embodiment of the present invention is not limited to such a structure. For example, if the sidewall member (electrode) 9 has an electrode member with dimensions capable of covering the opening part 6 of the case 4 and any one of contact portions (9A to 9D) extended to any one of the case side surfaces (4A to 4D) a surface-mount type inductance element can be constructed.

In the above-mentioned embodiment mode, the example in which the core 1 and the lead 2 have been hermetically sealed with the side wall members 9 in the surface-mount type inductance element has been described. However, the embodiment of the present invention is not limited to such a structure. For example, even in an inductance element having a structure in which end portions of the case 4 are hermetically sealed with a resin and the lead 2 is passed through the case in a hermetically sealed state, the noise generation amount can be reduced.

<Third Embodiment Mode>

In this embodiment mode, two kinds of inductance elements different from each other in the outer diameter of a core 1 will be manufactured without providing the hermetically sealed structure using adhesives 11 in the inductance element shown in FIGS. 3 and 4. Then, the degree of influence of noise resulting from contact between the core 1 and a case 4 is measured.

That is, in this embodiment, an inductance element having the core 1 with an outer dimension of 8.2 mm and a length of 15 mm is inserted into the case 4 having an opening part 6 which is 8.2 mm in inner diameter to produce an element L4, and an element L5 which is produced with the outer diameter of the core being 7.6 mm.

In this case, in the element L4, the outer surface of the core 1 is closely in contact with the inner surface of the hollow part 5 of the case 4. On the other hand, in the element L5, a clearance of 0.3 mm is present between the outer surface of the core 1 and the inner surface of the hollow part 5 of the case 4.

With respect to such two elements, the sound production quantities of the two elements are measured by the same procedure as that in the first embodiment mode.

Figure 7:
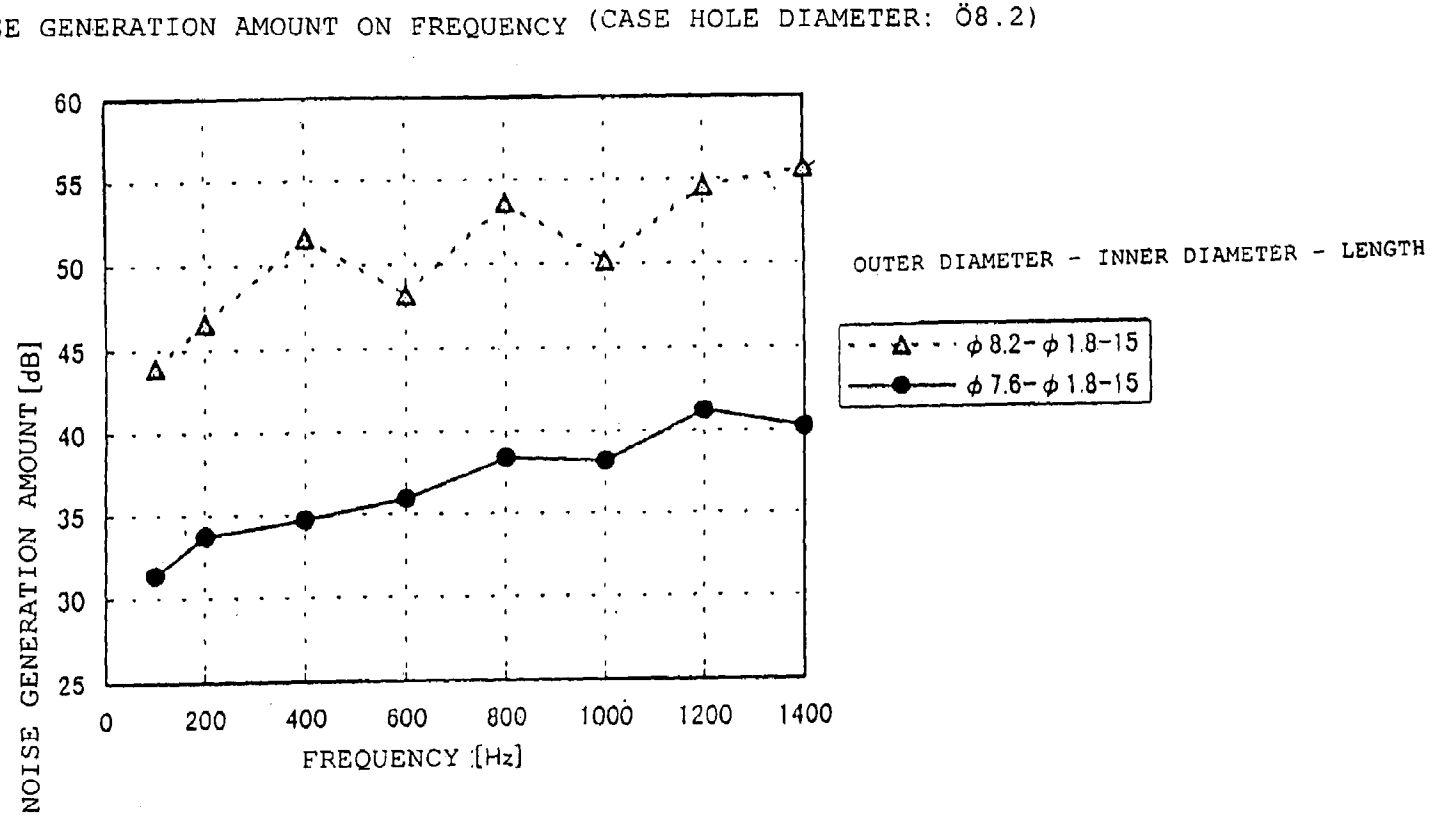
FIG. 7 shows measurements of a noise generation amount characteristic in an inductance element according to a third embodiment mode.

FIG. 7 shows measurements of the sound production quantities in such two elements. In FIG. 7, a graph of phi 8.2-phi 1.8–15 which is indicated by a symbol ( ) shows a measurement in the element L4 in which the core 1 is closely in contact with the case 4. On the other hand, a graph of phi 7.6-phi 1.8–15 which is indicated by a symbol ( ) shows a measurement in the element L5 in which the clearance is present between the core 1 and the case 4.

As shown in FIG. 7, over the whole measurement frequency range, the noise generation amount in the element L5 with the clearance is reduced by about 15 (dB) as compared with that in the element L4 with no clearance.

<Fourth Embodiment Mode>

Next, a case according to the present invention will be described. The case according to the present invention is constructed based on the following embodiment mode in addition to the above-mentioned embodiment modes 1 to 3.

Figure 8:
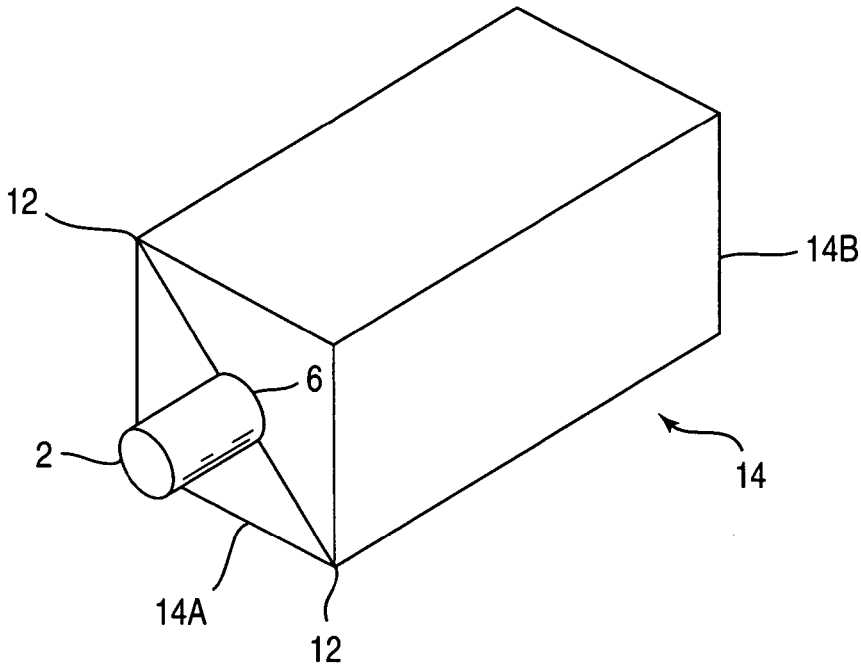
FIG. 8 is a perspective view of an inductance element according to a fourth embodiment mode.
Figure 9:
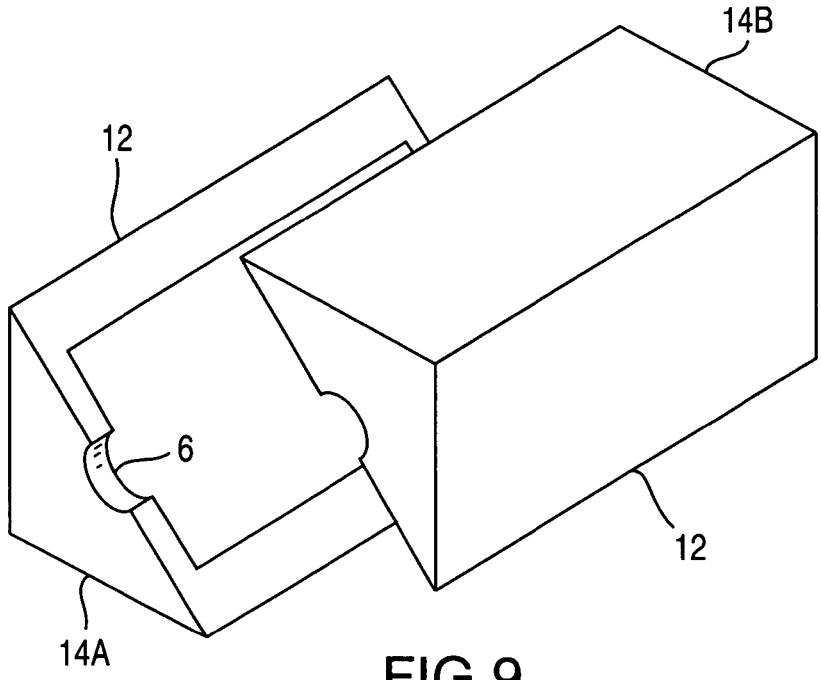
FIG. 9 is an exploded view of a case of the inductance element.

In this embodiment mode, FIG. 8 is a perspective view of an inductance element according to this embodiment mode. In addition, FIG. 9 is an exploded view showing a member 14A and a member 14B which compose the case 4 shown in FIG. 8. The inductance element is provided with a core 1 having the same shape as that of the cylindrical core 1 shown in FIG. 1 and is composed of a lead 2 that is passed through the core 1 and the case 4 that contains the core 1 as shown in FIG. 8.

The inductance element is produced according to the following procedure. First, amorphous metal is wound to form the core 1 having the hollow part. Then, the lead 2 is passed through the core 1 to obtain the inductance element.

The case 4 is formed such that its appearance is of a rectangular parallelepiped shape, and has an accommodation space for accommodating the core 1 in an inner portion. As shown in FIG. 9, the case 4 is composed of the member 14A and the member 14B which are divided along ridge lines 12. In addition, opening parts 6 are formed in the end surfaces of the case 4. The member 14A and the member 14B divide the opening parts 6 along diagonal lines in the end surfaces.

As a material of the case 4, for example, a synthetic resin such as PPS (polyphenylene sulfide) can be used.

In the case 4, the inductance element through which the lead 2 covers contained in one member 14A, and the other member 14B covers the member 14A. An adhesive is applied in advance onto bonding surfaces of the members 14A and 14B, and the members 14A and 14B are bonded to each other with the adhesive.

Figure 10:
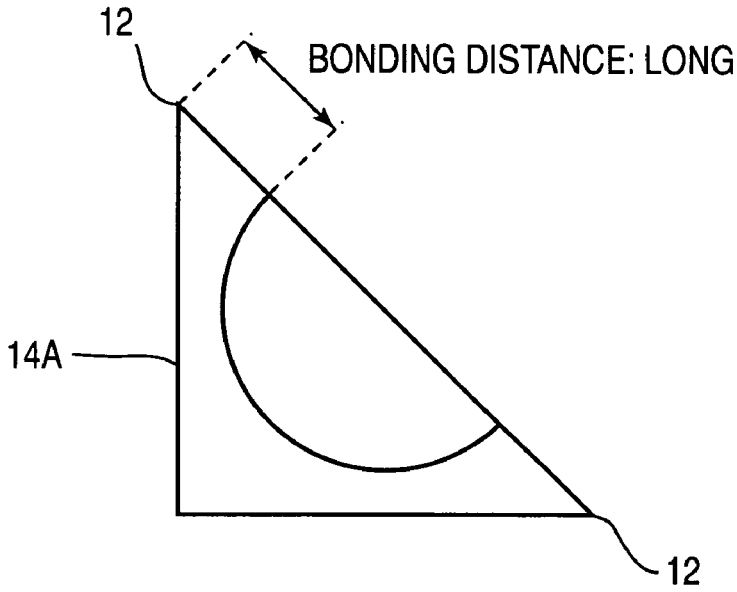
FIG. 10 is a sectional view of the case.
Figure 11:
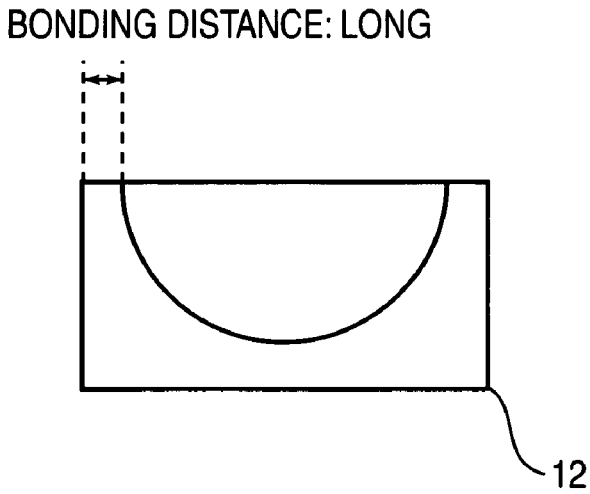
FIG. 11 is a sectional view of a comparative example.

FIG. 10 is a sectional view of the member 14A. In addition, FIG. 11 is a sectional view of a comparative example of the case 4.

As shown in FIG. 10, in the member 14A (and the member 14B), the bonding region is formed within a surface including the ridge lines 12 located on a rectangular shape cross section of the case perpendicular to the paper surface. On the other hand, in the comparative example shown in FIG. 11, the bonding region is formed within a surface which does not include the ridge lines 12 of the case.

Therefore, in the comparative example, the bonding surface is formed in a thin portion of the case, so that a bonding distance is short. On the other hand, in the member 14A, along bonding distance can be ensured, so that an area of the bonding region can be increased.

In the above-mentioned fourth embodiment mode, the members 14A and 14B are bonded within the surface including two ridge lines 12 which are present at the diagonal positions of the case 4 having the rectangular parallelepiped shape. However, the embodiment of the present invention is not limited to such a structure.

Figure 12:
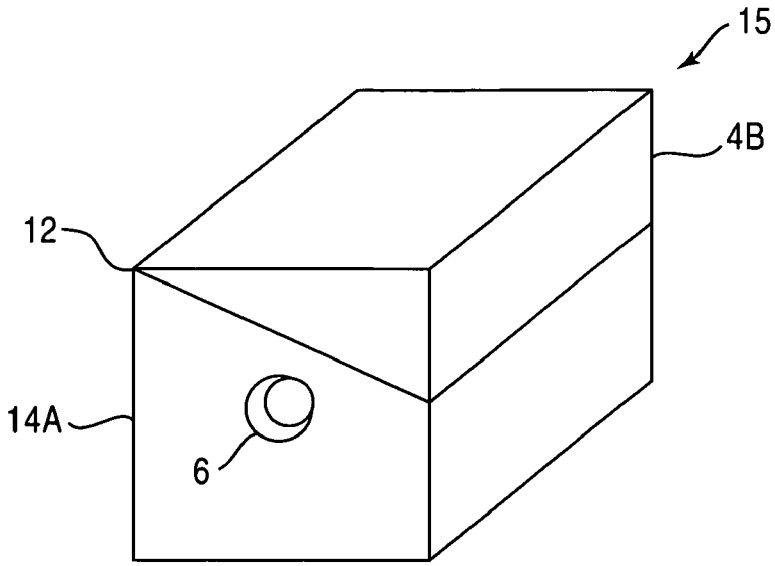
FIG. 12 is a perspective view (1) of a modified example.
Figure 13:
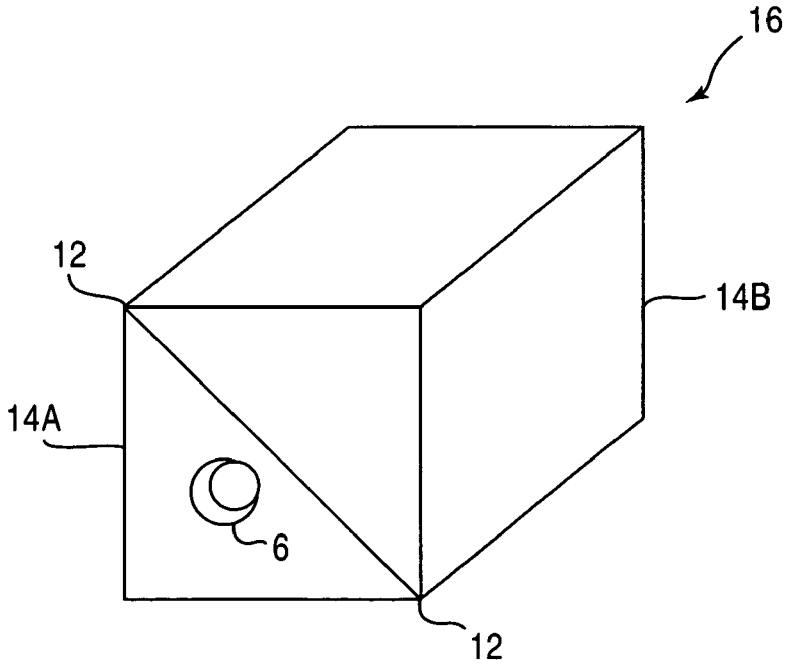
FIG. 13 is a perspective view (2) of the modified example.
Figure 14:
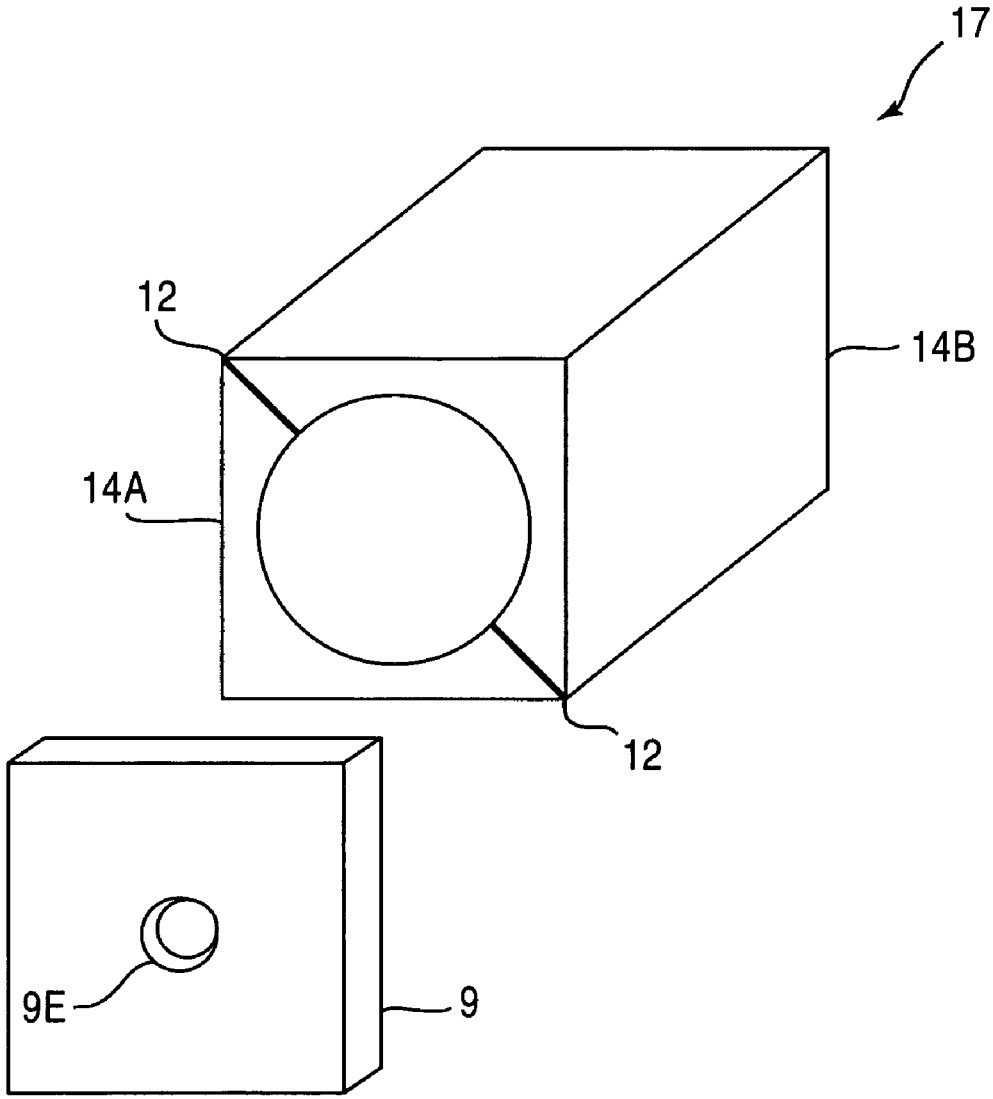
FIG. 14 is a perspective view (3) of the modified example.

For example, in the case of adopting such a manufacturing procedure in which the core 1 is contained in the case 4 and then the lead 2 is passed therethrough, it is unnecessary to divide the opening part 6 for the members 14A and 14B. FIGS. 12 to 14 are perspective views each showing such a structure.

In a case 15 shown in FIG. 12, the position of the opening part 6 is the same as that in the above-mentioned fourth embodiment mode. Note that the bonding region in which the member 14A and the member 14B are bonded is set at a position which includes a ridge line 12 of a rectangular parallelepiped and does not divide the opening part 6. As a result, the opening part 6 is provided in the member 14A.

Also, in a case 16 shown in FIG. 13, the position of the bonding region is the same as that in the above-mentioned embodiment mode. However, the opening part 6 is located not on the diagonal line of end surfaces (the center of the end surfaces) of the rectangular parallelepiped but in the member 14A. Note that, in the case where the opening part 6 is not located in the center of the end surfaces as described above, it is necessary to bend the lead 2 upon insertion into the core 1.

Also, a case 17 shown in FIG. 14 is composed of members 14A and 14B composing the rectangular parallelepiped member and side wall members (electrodes) 9. In this case, each of the side wall members 9 is not divided along the diagonal line, and an opening 9E is not divided in the bonding region. Thus, in any of the structures described above, the bonding distance between the members 14A and 14B can be lengthened.

In the above-mentioned embodiment mode, the members 14A and 14B are boned to each other with the adhesive. However, the embodiment of the present invention is not limited to such a structure. For example, the member 14A and the member 14B may be bonded to each other by ultrasonic bonding.

Note that, in any of the above-mentioned cases, it is preferable to hermetically seal the core 1 using the case 4 in view of noise insulation.

INDUSTRIAL APPLICABILITY

As described above, according to the present invention, in an inductance element provided with a magnetic wound core and a lead, vibration and noise leaked to the outside of the element can be reduced.

Also, according to the present invention, in a case that contains the magnetic core, an area of a bonding region of members composing the case can be increased without increasing the size of the case, whereby an increase in bulk of the inductance element can be prevented.

What is claimed is:

1. An inductance element comprising:

a magnetic wound core having a hollow part, which is formed by winding a magnetic ribbon therearound;

a case for hermetically sealing the winding type magnetic core, the case having a hollow part that accommodates the winding type magnetic core and side wall members made of metal, the side wall members having cover parts opposed to side surfaces of both ends of the winding type magnetic core in both ends of the hollow part, and edge parts extended from both the ends of the hollow part in an outside direction, the edge parts composing conductive contact parts to an object to be bonded provided outside of the hollow part; and a lead having a cross-sectional dimension smaller than an inner diameter of the hollow part of the winding type magnetic core, which is passed through the hollow part of the winding type magnetic core with a clearance therebetween, both ends thereof being connected with the respective side wall members.

* * * * *